US008550669B2

(12) United States Patent
Macwan et al.

(10) Patent No.: US 8,550,669 B2
(45) Date of Patent: Oct. 8, 2013

(54) ADJUSTABLE SLOPE CEILING RECESSED LIGHT FIXTURE

(75) Inventors: Mahendra Joseph Macwan, Streamwood, IL (US); Joseph Stauner, Algonquin, IL (US); Franklin Fong, Wheeling, IL (US)

(73) Assignee: Schneider Electric USA, Inc., Palatine, IL (US)

( * ) Notice: Subject to any disclaimer, the term of this patent is extended or adjusted under 35 U.S.C. 154(b) by 223 days.

(21) Appl. No.: 13/106,339

(22) Filed: May 12, 2011

(65) Prior Publication Data

US 2012/0287625 A1 Nov. 15, 2012

Related U.S. Application Data

(60) Provisional application No. 61/494,208, filed on May 9, 2011.

(51) Int. Cl.
*F21V 15/00* (2006.01)

(52) U.S. Cl.
USPC ..... 362/366; 362/373

(58) Field of Classification Search
USPC ..... 362/364–366, 373, 294, 264
See application file for complete search history.

(56) References Cited

U.S. PATENT DOCUMENTS

| | | | | |
|---|---|---|---|---|
| 4,729,080 | A | 3/1988 | Fremont et al. | |
| 5,548,499 | A * | 8/1996 | Zadeh | 362/366 |
| 5,672,004 | A * | 9/1997 | Schmidt, Jr. | 362/421 |
| 7,093,952 | B2 * | 8/2006 | Ono et al. | 362/194 |
| 2008/0080190 | A1 * | 4/2008 | Walczak et al. | 362/294 |
| 2010/0135007 | A1 * | 6/2010 | Seabrook | 362/218 |
| 2010/0296272 | A1 | 11/2010 | Roos et al. | |

* cited by examiner

*Primary Examiner* — Julie Shallenberger
(74) *Attorney, Agent, or Firm* — Nixon Peabody LLP

(57) ABSTRACT

An adjustable assembly for conveying heat away from a fixture. The adjustable assembly includes a sliding plate having a first side for mounting the fixture thereon and a curved surface opposite the first side. The adjustable assembly also includes a fixed heat sink having a mating surface adapted to allow the curved surface of the sliding plate to slide from a first position to a second position while maintaining a substantially flush contact between the curved surface of the sliding plate and the mating surface of the fixed heat sink. At least one fastener is also provided for securing the sliding plate to the fixed heat sink alternately in the first position or the second position.

18 Claims, 8 Drawing Sheets

ADJUSTABLE SLOPE CEILING RECESSED LIGHT FIXTURE

CROSS REFERENCE TO RELATED APPLICATIONS

This application claims priority to U.S. Provisional Application No. 61/484,208, filed May 9, 2011, the contents of which is incorporated entirely herein by reference.

FIELD OF THE INVENTION

The present disclosure relates generally to recessed lighting fixtures, and, more particularly, to an adjustable recessed light fixture for mounting in a sloped or inclined ceiling and to a heat sink therefore.

BACKGROUND

Light emitting diodes ("LEDs") offer some advantageous over other types of lighting fixtures, such as incandescent and fluorescent lighting fixtures. LED lighting fixtures are generally more energy efficient, have longer operating lives, and contain less harmful products simplifying waste management and recycling requirements. Unlike recessed fixtures in which the light source is an incandescent, fluorescent, or halogen bulb, for example, in recessed fixtures having LEDs as the light source, the heat generated by the LEDs radiates backwards, in the opposite direction of light emission. By contrast, incandescent, fluorescent, and halogen light sources radiate much of the heat away from the fixture, in the same direction as the light radiation. Thus, in fixtures having LEDs, the interior of the enclosure traps the heat radiated backwards by the LEDs, creating a hot environment for the LEDs. LEDs are particularly sensitive to degradation due to excessive heat, and over time, their luminance can degrade, or worse, their lifetime can be drastically reduced when they are exposed to prolonged heat.

Recessed lighting fixtures have been proposed for use with sloped ceilings. In sloped ceilings, the light source must be angled relative to the ceiling so that light radiation can propagate in a desired direction, which typically varies from the sloped angle of the ceiling. What is needed is an adjustable recessed lighting fixture that effectively transfers heat generated by LEDs away from the LEDs to provide a relatively cool environment for the LEDs, thereby prolonging their lifespan and luminosity while allowing the fixture to be installed into different ceilings at various sloped angles relative to horizontal.

BRIEF SUMMARY

Provided herein is a recessed fixture for being mounted within a sloped, or inclined, ceiling, and an associated adjustable heat sink assembly therefore. The heat sink assembly has two parts, a sliding plate adapted for mounting a fixture, such as, for example, an LED light fixture, thereon, and a fixed heat sink. The sliding plate and the fixed heat sink include complementary surfaces adapted to allow the sliding plate to slide along the fixed heat sink while maintaining a substantially flush contact between the sliding plate and the fixed heat sink.

According to an aspect of the present disclosure, an adjustable assembly for conveying heat away from a fixture is provided. The adjustable assembly includes a sliding plate, a fixed heat sink, and at least one connector. The sliding plate has a first side and a second side opposite the first side. The first side is adapted for mounting the fixture thereon so as to receive heat energy generated by the fixture and transfer the heat energy to the second side. At least a portion of the second side includes a curved surface. The fixed heat sink has a first side including a mating surface adapted to allow the curved surface of the sliding plate to slide from a first position to a second position while maintaining a substantially flush contact between the curved surface of the sliding plate and the mating surface of the fixed heat sink. The at least one fastener secures the sliding plate to the fixed heat sink alternately in the first position or the second position.

According to another aspect of the present disclosure, a system for dissipating thermal energy is provided. The system includes a sliding plate, a fixed heat sink, at least one fastener, and an enclosure. The sliding plate has a first side and a second side opposite the first side. The first side is adapted to mount a heat generating device thereon. The sliding plate is adapted to conductively transfer thermal energy from the first side of the sliding plate to the second side of the sliding plate. At least a portion of the second side includes a curved surface. The fixed heat sink has a first side including a mating surface adapted to allow the curved surface of the second side of the sliding plate to slide from a first position to a second position while maintaining a substantially flush contact between the curved surface of the sliding plate and the mating surface of the fixed heat sink. The fixed heat sink is adapted to receive conductively transferred thermal energy from the sliding plate via the substantially flush contact between the curved surface of the sliding plate and the mating surface of the fixed heat sink. The at least one fastener secures the sliding plate to the fixed heat sink alternately in the first position or the second position. The enclosure is for housing the sliding plate, the fixed heat sink, and the heat generating device within a recessed cavity of a finished construction. The fixed heat sink is securely attachable to an inner wall of the enclosure such that at least one of the first position or the second position of the sliding plate is a position orienting the heat generating device at an angle other than an angle perpendicular to a plane of the finished construction surrounding the recessed cavity.

According to still further aspects of the present disclosure, a recessed light fixture is provided. The recessed light fixture includes a sliding plate, a fixed heat sink, at least one fastener, a light source, an enclosure, and a reflector. The sliding plate has a first side and a second side opposite the first side. At least a portion of the second side includes a curved surface. The fixed heat sink has a first side including a mating surface adapted to allow the curved surface of the second side to slide from a first position to a second position while maintaining a substantially flush contact between the curved surface and the mating surface. The fixed heat sink includes a plurality of fins for radiating heat energy conducted from the first side of the sliding plate. The plurality of fins extend from a side of the fixed heat sink opposite the first side. The at least one fastener is for securing the sliding plate to the fixed heat sink alternately in the first position or the second position. The light source is mountable to the first side of the sliding plate. The enclosure is for housing the sliding plate, the fixed heat sink, and the light source. The enclosure includes a mounting assembly for securing the enclosure in a recessed cavity of a ceiling. The enclosure has an opening on a side of the enclosure facing a space below the ceiling to be illuminated. The reflector is for directing light emitted by the light source toward the opening of the enclosure. The reflector is adapted to removably couple to the sliding plate.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

Figure 1A:
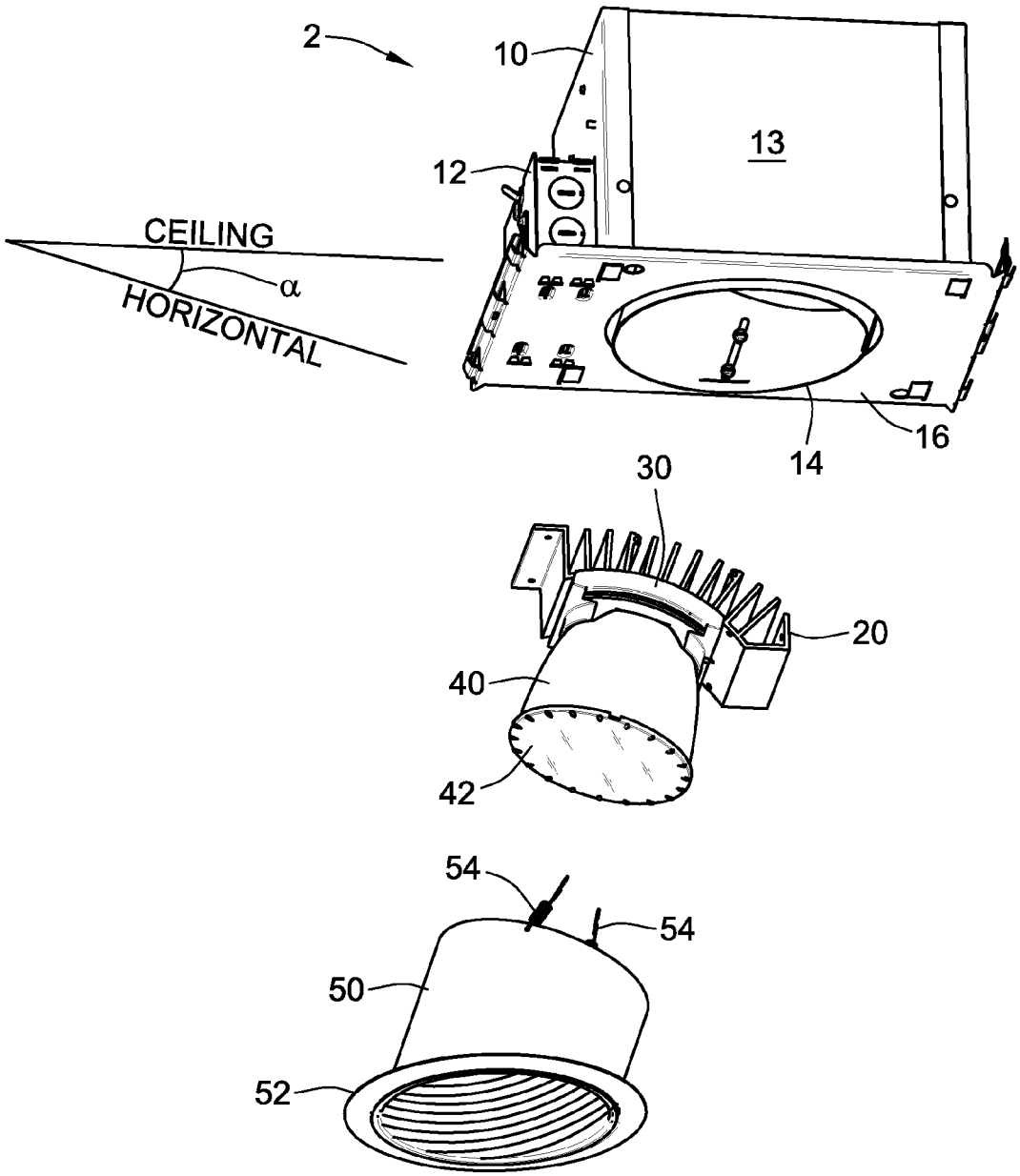
FIG. 1A is an exploded view of a recessed lighting fixture according to an implementation of the present disclosure.
Figure 1B:
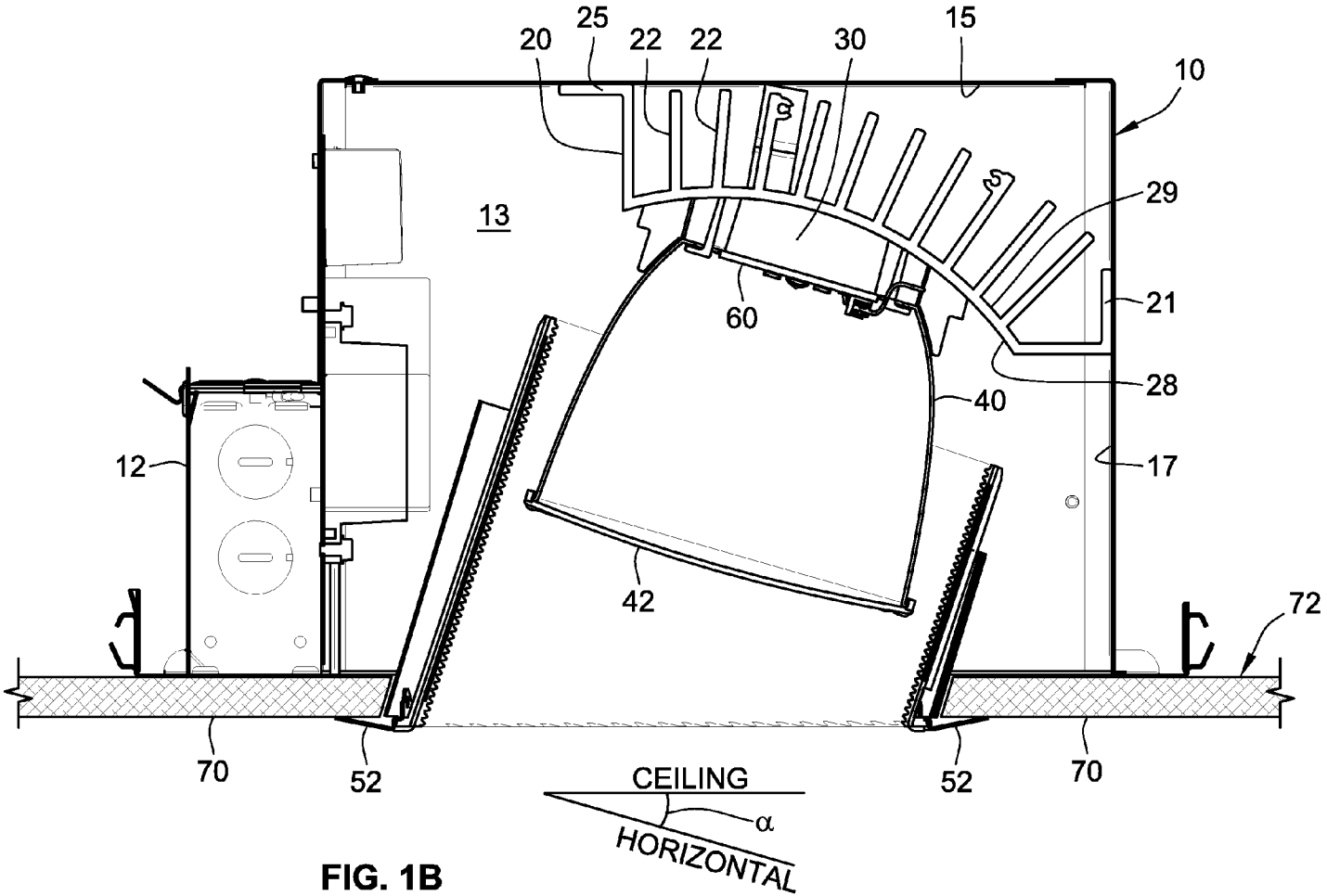
FIG. 1B is an assembled view of a profile cross-section of the recessed lighting fixture shown in FIG. 1A.

FIG. 1A is an exploded view of a recessed lighting fixture according to an implementation of the present disclosure. FIG. 1B is an assembled view of a profile cross-section of the recessed lighting fixture shown in FIG. 1A. The recessed lighting fixture shown in FIGS. 1A and 1B includes a rough-in box 2, a fixed heat sink 20, a sliding plate 30, an LED panel 60 (FIG. 1B), a reflector 40, a lens 42, a baffle 50, and a trim ring 52.

The rough-in box 2 includes an enclosure 10, a junction box 12, and bar hangers (not shown). The rough-in box 2 is adapted to be mounted within a recessed cavity of a finished construction, such as a recessed cavity of a finished sloped ceiling. The enclosure can be mounted within a recessed cavity of a suspended ceiling, or of a ceiling constructed with joists, such as wood joists. Using bar hangers and/or aspects of the rough-in box 2 securely coupled or integrally formed with the enclosure 10, the rough-in box 2 can be mounted in a recessed cavity of a suspended ceiling or a wood joist construction ceiling. For example, where the rough-in box 2 is supported by bar hangers connected to joists, the bar hangers can be telescopically adjusting to account for variations in the spacing of the joists and can include feet adapted to be nailed to a bottom portion of joists. The bar hangers can also include apertures for driving nails or other fasteners into the joists to thereby support the rough-in box.

According to implementations of the present disclosure, the rough-in box 2 is adapted to be mounted within a recessed cavity of a sloped ceiling, (e.g. a ceiling having a plane which intersects a plane of a horizontal floor at an angle, such as the angle $\alpha$, shown in FIG. 1A). In a sloped-ceiling implementation, a fixture (e.g., a light fixture including the LED panel 60, the reflector 40, and the lens 42) mounted within the enclosure 10 is allowed to be directed generally vertically downward and normal with respect to a horizontal floor. However, implementations of the present disclosure can also include configurations where the rough-in box is mounted within a recessed cavity of a flat ceiling (i.e., a ceiling lying in a plane substantially parallel with a plane of a horizontal floor). In a flat ceiling implementation, a fixture (e.g., a light fixture including the LED panel 60, the reflector 40, and the lens 42) mounted within the enclosure 10 is allowed to be directed other than vertically downward. For example, in a flat ceiling configuration, a fixture (e.g., a light fixture including the LED panel 60, the reflector 40, and the lens 42) mounted with the enclosure 10 is directed generally toward a vertical wall so as to, for example, illuminate a space by indirect lighting or illuminate a featured art work presented on the vertical wall.

The junction box 12 is preferably constructed of a rigid material such as metal or plastic and can be mounted on an exterior portion of the enclosure 10. The junction box 12 includes a plurality of knockouts and can include clamps for securing sheathed electrical cables to the junction box 12. The junction box 12 can be pre-wired with electrical wires for providing power to a fixture within the enclosure 10. The enclosure 10 and/or the junction box 12 can incorporate an access door for providing access to the interior of the junction box 12 from the inside of the enclosure 10 or from the exterior of the enclosure 10, respectively. The enclosure 10 can be constructed from a rigid conductive material, such as a metal including, for example aluminum having a thickness of 0.032 inches. The enclosure 10 has a lower surface 16 having an opening 14 allowing for access to an interior of the enclosure 10.

When installed, the rough-in box 2 is preferably situated in a ceiling such that the opening 14 of the enclosure 10 aligns with a corresponding hole in the ceiling, which hole can be elliptical. In FIG. 1B, the rough-in box 2 is mounted within a recessed cavity of a ceiling defined by drywall 70. A hole in the drywall 70 surrounds the opening 14, and the lower surface 16 of the enclosure 10 is proximate to a back side 72 of the drywall 70. When the rough-in box 2 is property mounted within a ceiling, the lower surface 16 can optionally abut or nearly abut the back side 72 of the drywall 70. The enclosure 10 can also include one or more mounting points, clips, clamps, and the like suitable for directing electrical wires within the enclosure, and for mounting fixtures internally to the enclosure 10. Additionally, in implementations where the enclosure 10 houses a light fixture having an LED ("light emitting diode") light source, the enclosure 10 can house an LED driver or an LED driver can be mounted to an exterior portion of the enclosure 10 to enable external servicing of the LED driver. The LED driver can receive alternating current (AC) power signals from the junction box 12 and convey driver signals to drive one or more LEDs, such as the LEDs on the LED panel 60. The LED driver can optionally be configured to dim light emitted from LEDs according to adjustments made to a standard wall dimmer switch.

The enclosure 10 can include mounting points aligned to receive fasteners for securely coupling ("fastening") the fixed heat sink 20 to an internal side wall and/or internal top surface of the enclosure 10. By securely coupling the fixed heat sink 20 internally to the enclosure 10, the fixed heat sink 20 thereby provides a secure mounting point for the sliding plate 30 to mount an LED panel 60 (as shown in FIG. 1B). In addition, the secure coupling between the fixed heat sink 20 and the enclosure 10 preferably enables conductive thermal transfer of thermal energy from the fixed heat sink 10 to the enclosure 10. The sliding plate 30 is also removably coupled to the reflector 40. The reflector 40 directs light emitted by the LED panel 60 toward the opening 14 of the enclosure 10 and toward a space to be illuminated below the ceiling having the recessed cavity in which the rough-in box 2 is mounted. By "fixed" heat sink 20, it is meant herein that once installed into the enclosure 10, the heat sink 20 is not intended to be adjustable like the sliding plate 30. As described herein, the heat sink 20 is fastened, e.g., by screws, to the interior of the enclosure 10, but the sliding plate 30 has fasteners 25 that are intended to be tightened and loosened to allow the sliding plate 30 to be moved relative to the fixed heat sink 20 post-installation of the rough-in box 2. In other words, once installed, the heat sink 20 is intended to remain in a fixed position within the enclosure 10, whereas the sliding plate 30 is intended to be adjustably moved among different positions relative to the fixed heat sink 20.

Figure 2A:
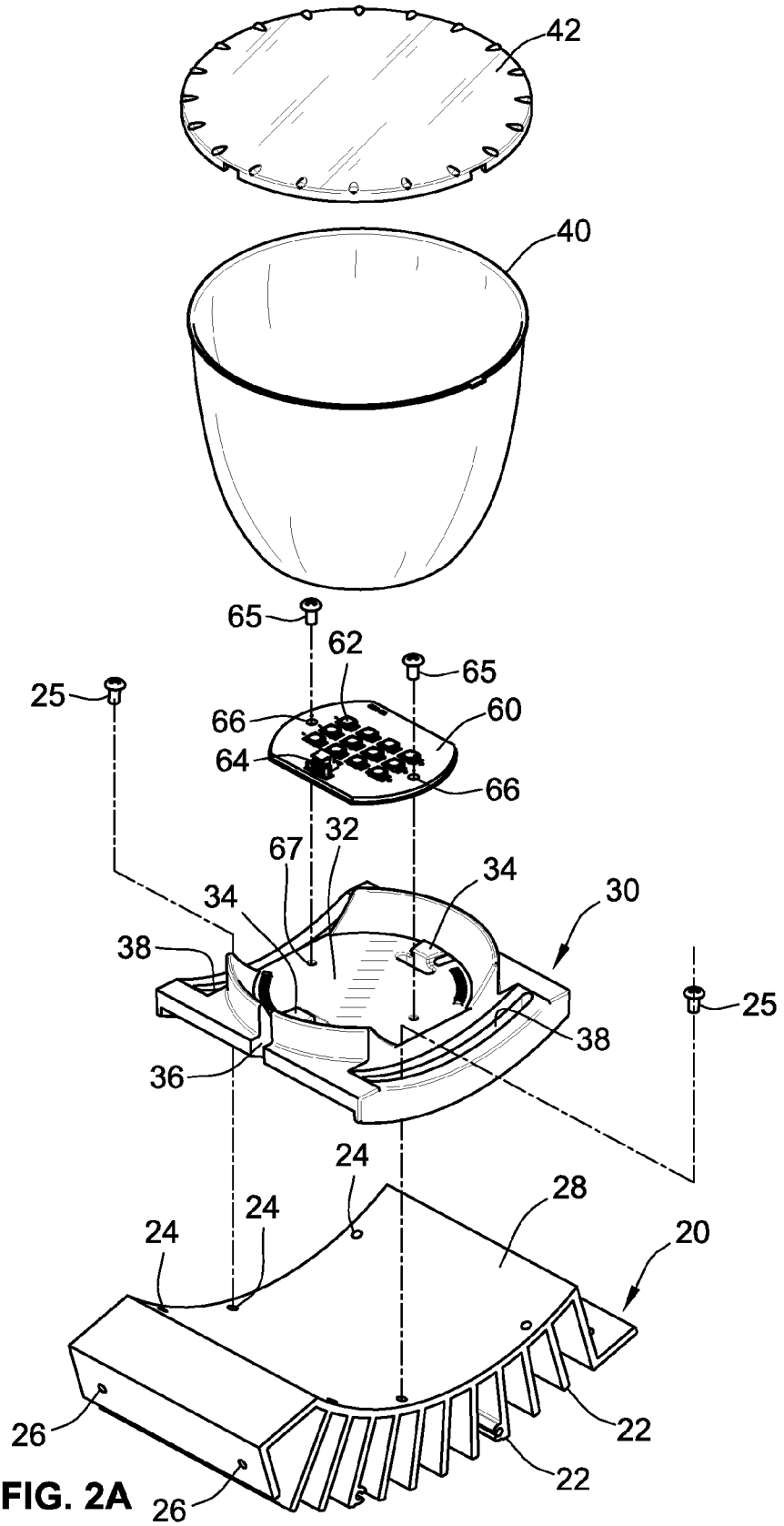
FIG. 2A is an exploded aspect view of the fixed heat sink, the sliding plate, the LED panel, the reflector, and the lens from a top side point of view.
Figure 2B:
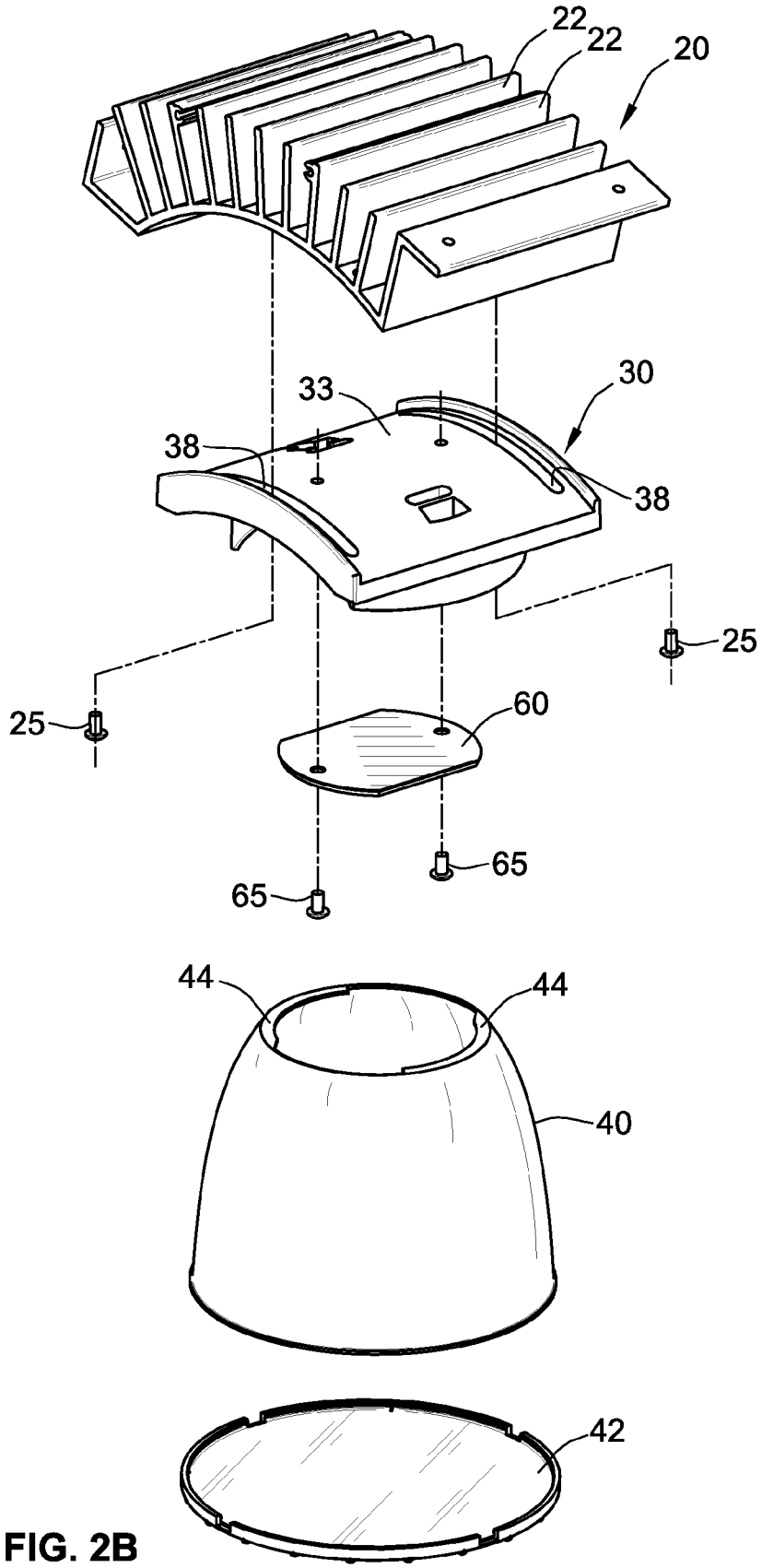
FIG. 2B is an exploded aspect view of the components shown in FIG. 2A, but from a bottom side point of view.

In FIG. 1A, the fixed heat sink 20, the sliding plate 30, the LED panel 60 (shown in FIG. 1B), and the reflector 40 are shown in an assembled configuration. FIGS. 2A-2B show views of these components in exploded views, and their operation and inter-connections are therefore further described in connection with FIGS. 2A-2B.

The baffle 50 extends from the opening 14 of the enclosure 10 to surround the lens 42 and provides a finished appearance to the recessed light fixture by masking regions of the interior of the enclosure 10. In addition, the baffle 50 optionally includes a plurality of ridges that assist in diffusing and/or directing the emitted light from the LED panel 60 toward the area to be illuminated. The trim ring 52 surrounds the baffle 50 and provides a clean edge to the exterior appearance of the recessed light fixture, and can anchor the baffle 50 proximate to the ceiling by pressing against the finished portion of the drywall 70 (as shown in FIG. 1B). The baffle 50 is secured within the housing 10 by connecting the retaining springs 54 to connection points (such as hooks, loops, etc.) within the enclosure 10. The trim ring 52 and the baffle 50 therefore provide a finished appearance to the recessed lighting fixture while directing light emitted by the LED panel 60 toward the region to be illuminated. The trim ring 52 (and the baffle 50) can be interchangeable and can be selected from a plurality of standard trims, e.g., baffle trims, cone trims, lensed trims, and decorative trims, which are commonly available for use with both incandescent and compact fluorescent light (CFL) housings.

Figure 3:
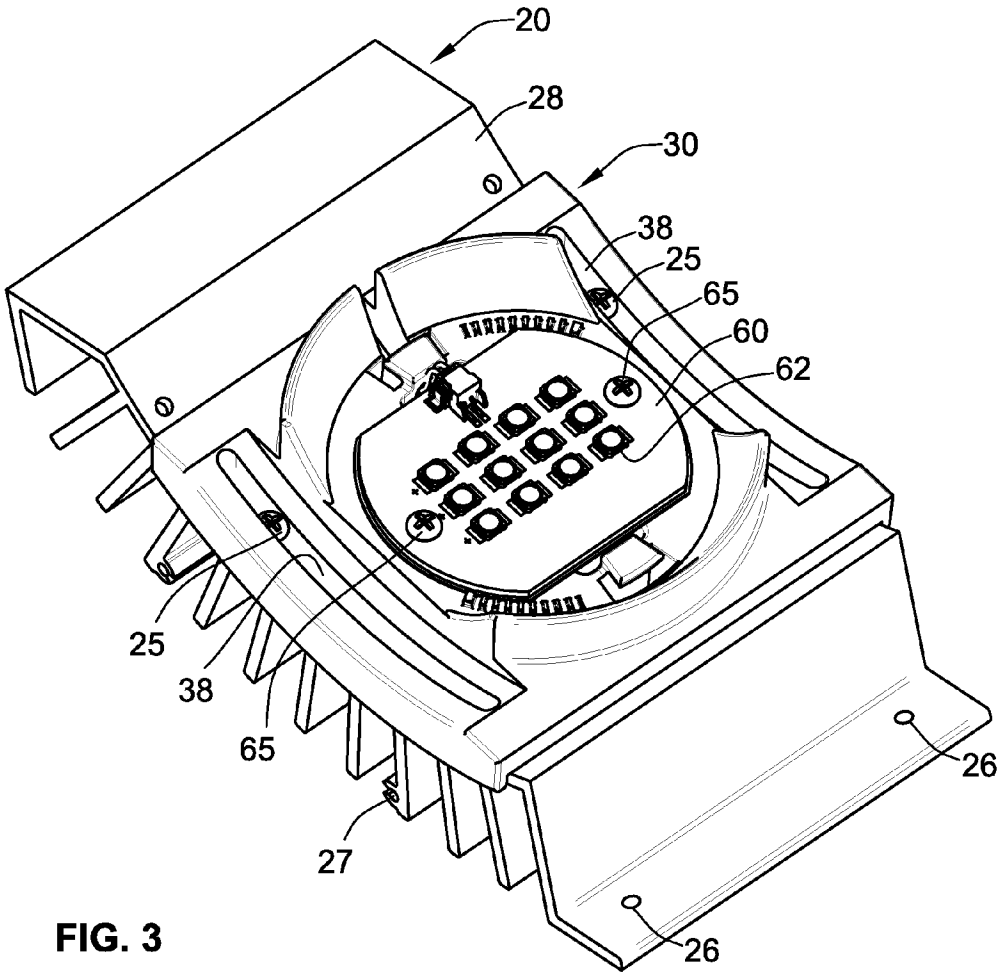
FIG. 3 illustrates the components shown in FIGS. 2A and 2B in an exemplary assembled configuration and without the reflector and lens assembly.

FIG. 2A is an exploded aspect view of the fixed heat sink 20, the sliding plate 30, the LED panel 60, the reflector 40, and the lens 42 from a top side point of view. FIG. 2B is an exploded aspect view of the components shown in FIG. 2A, but from a bottom side point of view. FIG. 3 illustrates the components shown in FIGS. 2A and 2B in an exemplary assembled configuration and without the reflector and lens assembly 40, 42. The components illustrated in FIGS. 2A, 2B and 3 will therefore be described with reference to FIGS. 2A, 2B, and 3.

The reflector 40 and the lens 42 are specifically designed to provide a desired light distribution while masking or diffusing individual LEDs (e.g., the LED 62) on the LED panel 60 and simulating the appearance from below a finished ceiling of familiar incandescent BR or PAR lamps with an attractive frosted lens. Together, the reflector 40 and the lens 42 form a reflector and lens assembly 40, 42. In an exemplary embodiment, the light distribution from the reflector and lens assembly replicates the performance of a 65 W BR30, one of the most popular incandescent lamps currently being used in recessed light fixtures. The lens 42 diffuses light emitted by the LEDs on the LED panel 60 and can be a frosted lens or include other optical characteristics for diffusing and/or scattering light from the LED panel 60. Furthermore, the LED panel can provide light with a color temperature chosen from a range of temperatures appropriate for residential and/or commercial lighting.

The LED panel 60 includes a plurality of LEDs (e.g., the LED 62) mounted to a printed circuit board (PCB) having appropriate electrical connections wired to an electrical terminal 64. The electrical terminal 64 can, for example, be electrically coupled to an LED driver that emits driving signals for causing the LED panel to emit light. The electrical terminal 64 is coupled to electrical wires (not shown) that pass through the channel 36 in the sliding plate 30 so as to avoid interference with a thermal connection between the sliding plate 30 and the fixed heat sink 20 (the thermal connection being described further herein below). The LED panel 60 can optionally include thermal contacts for transferring heat generated by each LED (e.g., the LED 62) to the rear side of the PC board. For example, the PC board of the LED panel 60 may include thermally conductive thermal vias integrated within the PC board to provide thermal management to the LEDs on the LED panel 60.

The LED panel 60 is securely coupled to the sliding plate 30. The LED panel 60 includes holes 66 adapted to be aligned with matching attachment points 67 on a flat surface 32 of the sliding plate 30. The LED panel 60 can then be securely attached to the flat surface 32 by securing fasteners 65 through the holes 66 and within the attachment points 67. While the LED panel 60 is thus securely attached, the sliding plate can receive, via conductive thermal transfer, thermal energy generated on the LED panel 60. By utilizing screws as the fasteners 65, the LED panel 60 can be easily replaced (e.g., removing the fasteners 65, replacing the LED panel 60 with a new LED panel, and replacing the fasteners 65). The LED panel 60 can also be fastened to the flat surface 32 via surface mount push-in connectors that can facilitate easy and quick removal and/or installation of the LED panel 60.

The sliding plate 30 also includes a plurality of reflector retainers 34 for removably attaching the reflector 40 to the sliding plate 30. As shown in FIGS. 2A and 2B, two reflector retainers 34 are integral with the flat surface 32 of the sliding plate 30. The reflector retainers 34 generally have a raised portion extending away from the interior (i.e., center position) of the flat surface 32. In general, the reflector retainers 34 (shown in FIG. 2A) are configured to receive a plurality of tabs 44 (shown in FIG. 2B) of the reflector 40 for mounting the reflector and lens assembly 40, 42 to the sliding plate 30. For example, the reflector 40 is mounted to the reflector retainers 34 by rotating one-quarter turn clockwise such that the tabs 44 of the reflector 40 are securely captured by the reflector retainers 34. To remove the reflector 40, the reflector 40 is rotated one-quarter turn counter-clockwise to release the captured tabs 44 from the reflector retainers 34. Furthermore, the reflector retainers 34 are generally symmetrically positioned with respect to a center of the flat surface 32 of the sliding plate 30 so as to center the reflector 40 with respect to the LED panel 60 mounted on the sliding plate 30.

Opposite the side of the sliding plate 30 having the flat surface 32, the sliding plate 30 has a curved surface 33. The curved surface 33 is adapted to abut a mating surface 28 of the fixed heat sink 20 while the sliding plate 30 is in more than one position as will be described further herein. For example, the curved surface 33 can provide a substantially flush, continuous interface to the mating surface 28. By providing a substantially flush, continuous connection between the sliding plate 30 and the fixed heat sink 20 defined by the curved surface 33 and the mating surface 28, the sliding plate 30 advantageously conductively transfers thermal energy from the LED panel 60 mounted on the flat surface 32 to the fixed heat sink 20. The mating surface 28 is curved at a radius to match the radius of the curve of the curved surface 33 where the two surfaces 28, 33 are physically joined. The surfaces 28, 33 are complementary, such that the curved surface 33 is convex relative to the mating surface 28, and the mating surface 28 is concave relative to the curved surface 33.

For example, the curved surface 33 of the sliding plate 30 is a portion of an external cylindrical surface being described according to conventional cylindrical coordinates of radius, angle, and height. According to the conventional cylindrical coordinates, the angular extent of the curved surface 33 is less than pi radians. According to the conventional cylindrical coordinates, the radial coordinate defining the curved surface 33 is independent of the angular coordinate defining the curved surface 33. The mating surface 28 is a complementary portion of an internal cylindrical surface being described according to the same conventional cylindrical coordinates as the curved surface 33. In particular, while the example curved surface 33 and mating surface 28 illustrated in the drawings as surfaces having a constant radial dimension with respect to a central radial axis, implementations of the present disclosure are not so limited. Alternative implementations of the curved surface 33 and the mating surface 28 may, for example, be defined by a radial coordinate that varies with the height coordinate of the cylindrical coordinates defining the surfaces 28, 33. Allowing the radial dimension to vary with respect to height may result in the curved surfaces 33 having, for example, channels, ridges, or modulations, which are mapped on to complementing structures of the mating surface 28. Allowing the radial coordinate defining the surfaces 28, 33 to vary with respect to the height coordinate does not prevent the sliding plate 30 from sliding relative to the fixed heat sink 20. Additionally, the radial coordinate defining the surfaces 28, 33 can be a constant radius, as the surfaces 28, 33 are shown in FIGS. 1A through 5.

In addition, where the curved surface 33, and the mating surface 28 are defined according to conventional cylindrical coordinates, the coordinates can be selected such that the axis of rotation of the coordinate system is an axis internal to the enclosure 10 when the fixed heat sink 20 is mounted within the enclosure 10. The axis thus defines the axis of rotation of the sliding plate 30 and, when mounted thereon, the reflector 40 and lens 42. For example, the axis of rotation of the sliding plate 30 can be chosen to be roughly proximate to a point on the lens 42. Selecting the axis of rotation of the curved surface 33 and the mating surface 28 to be near the lens 42 advantageously minimizes a displacement of the lens 42 with respect to the opening 14 and the baffle 50 and trim ring 52 during an adjustment of the angular direction of the light fixture.

The fixed heat sink 20 includes a plurality of fins 22 for radiating thermal energy conductively transferred to the fixed heat sink 20 via the mating surface 20. The fins 22 are generally positioned opposite the side of the fixed heat sink 20 having the mating surface 28 so as to avoid interference with the thermal coupling between the sliding plate 30 and the fixed heat sink 20 via their respective curved surface 33 and mating surface 28.

The sliding plate 30 includes a pair of elongated apertures 38 formed along outer edges of the sliding plate 30. A fastener 25, such as a screw, is inserted through the elongated aperture 38 and received into one of a plurality of anchoring point 24 in the fixed heat sink 20. The fastener 25 secures the sliding plate 30 to the fixed heat sink 20. In this illustrated example, three anchoring points 24 are formed in the fixed heat sink 20 to receive the fastener 25 in one of three different positions, allowing the sliding plate 30 to be adjustable among one of those three positions. To adjust the position of the sliding plate 30, the fastener is loosened so that the sliding motion of the sliding plate 30 is not impeded with respect to the fixed heat sink 20. The elongated aperture 38 has a length that spans across the positions of the three anchoring points 24 in the fixed heat sink 20 to allow adjustment among a range of angles defined by the anchoring points 24. This range of angles allows the reflector and lens assembly 40, 42 to be installed in differently sloped ceiling configurations, each being sloped a different angle relative to horizontal. More or fewer positions are contemplated, depending upon the variability of slopes of the ceilings into which the rough-in box 2 is to be installed. Although not necessary, it is preferable that when installed, the fastener 25 is secured in approximately a central area of the elongated aperture 38. The installer should therefore orient the reflector and lens assembly 40, 42 such that the light propagates in the desired direction, and then tighten the fasteners 25 in the anchoring points 24 where the fasteners 25 are approximately centrally located within the elongated aperture 38. The sliding plate 30 can also include hash marks along the elongated apertures 38 to allow an installer to reference a common point for the location of the fasteners 25 when installing the sliding plate 30. The hash marks advantageously allow for an installer to install many of the recessed lighting fixtures at a common angle in a ceiling having a uniform slope without independently determining an alignment for each fixture by referring the position of the fasteners 25 to a common hash mark adjacent the elongated apertures 38.

The installer can also optionally include a second fastener to further stabilize and secure the sliding plate 30 to the fixed heat sink 20. For example, if a desired direction of propagation of light emission requires that the sliding position be oriented on the fixed heat sink such that two anchoring points 24 are visible through each of the elongated apertures 38, an installer can install a second fastener (e.g., similar to the fastener 25) can be inserted through the elongated apertures 38. In particular, positions of the anchoring points 24 on the fixed heat sink 20 can be selected such that a central one of the anchoring points 24 on each side fixed heat sink 20 is the only anchoring point visible until the sliding plate varies by a predetermined amount from the center point of the curved surface 28 on the fixed heat sink 20.

FIG. 3 illustrates a bottom-facing view of the fixed heat sink 20, the sliding plate 30, the LED panel 60, the reflector 40, and the lens 42 shown in FIGS. 2A and 2B in an exemplary assembled configuration. The fasteners 25 are received within the elongated apertures 38 and tightened so that the LED panel 60 is oriented at the desired angle relative to horizontal. Note that the fasteners 25 are not located centrally within the elongated apertures 38, because as discussed above, it is preferable but not necessary to orient the fasteners 25 in a central area of the elongated apertures 38.

Figure 4A:
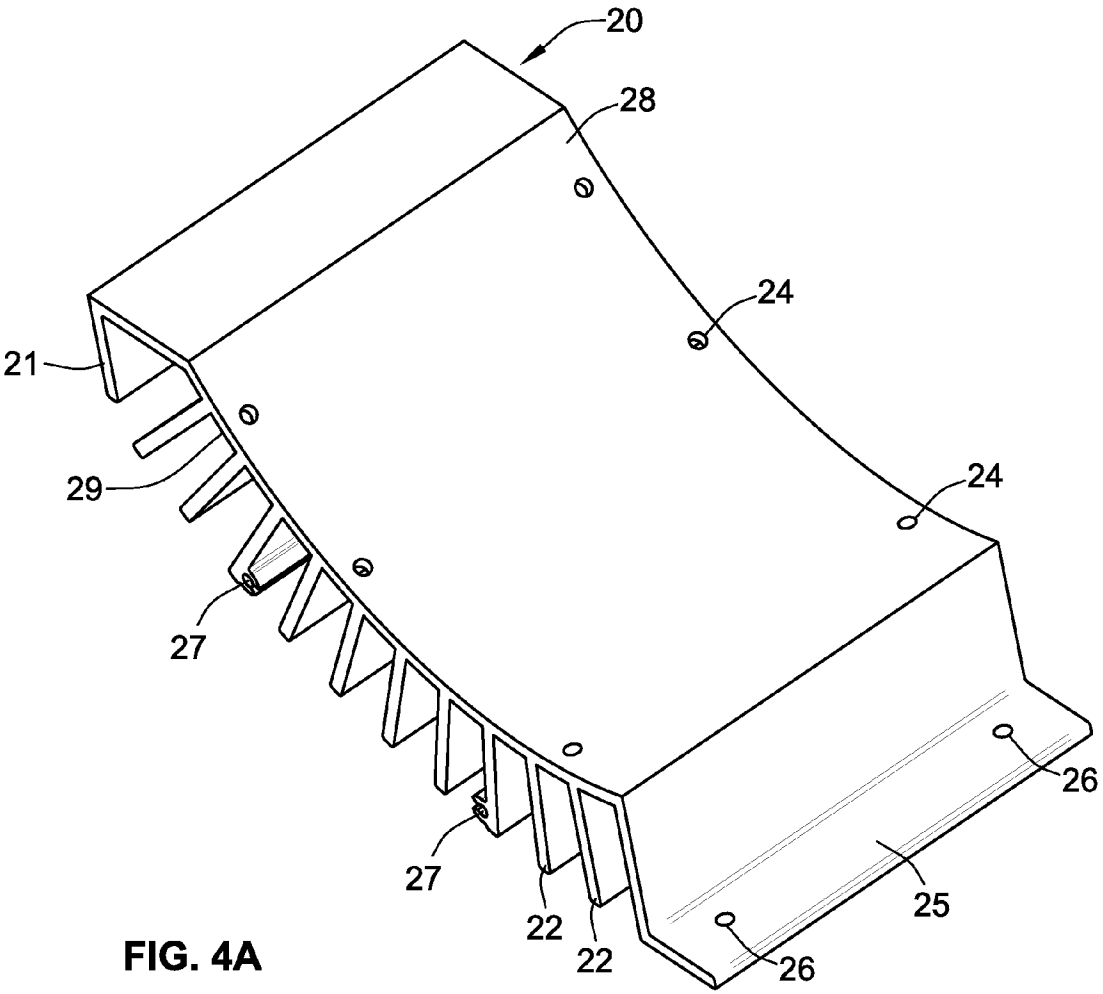
FIG. 4A is a perspective view of an exemplary fixed heat sink as shown installed into the enclosure of FIG. 1A.

FIG. 4A is a perspective view of an exemplary fixed heat sink 20 as shown installed into the enclosure 10 of FIG. 1A. The fixed heat sink 20 can be an extruded die cast component composed of aluminum or another thermally conductive material. In this example, the heat sink 20 includes a plurality of spaced-apart fins 22 arranged along a back surface 29 opposite the mating surface 28 of the heat sink 20. Each fin 22 is generally rectangular in shape and spans across the narrow dimension of the back surface 29. In this example, each fin 22 is equidistantly spaced relative to one another. In FIG. 4A, two fins include fastener receiving channels 27 for receiving a fastener, such as a screw, and securing the heat sink 20 to one or both side walls 13 of the enclosure 10. In addition, apertures 26 formed on flanges 21, 25 allow fasteners, such as screws, to secure the heat sink 20 to corresponding top surface 15 and end wall 17 of the enclosure 10. These attachment interfaces (three in this example, though fewer or more attachment interfaces are contemplated) allow heat energy radiating from the heat sink 20 to be conductively transferred to the metal enclosure 10, further dissipating the heat that would otherwise become trapped within the enclosure 10.

Figure 4B:
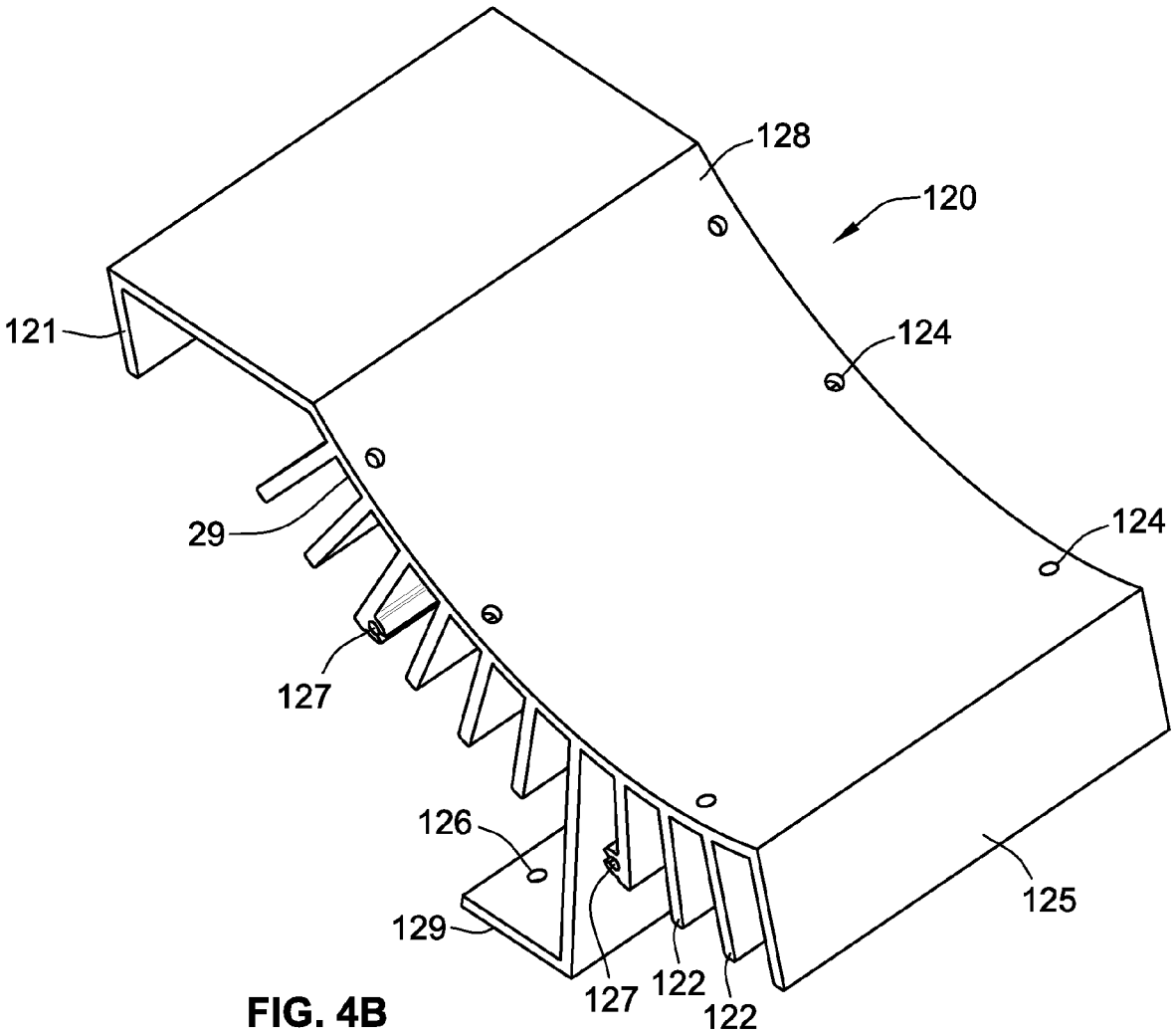
FIG. 4B illustrates a perspective view of another exemplary heat sink in another implementation.
Figure 5:
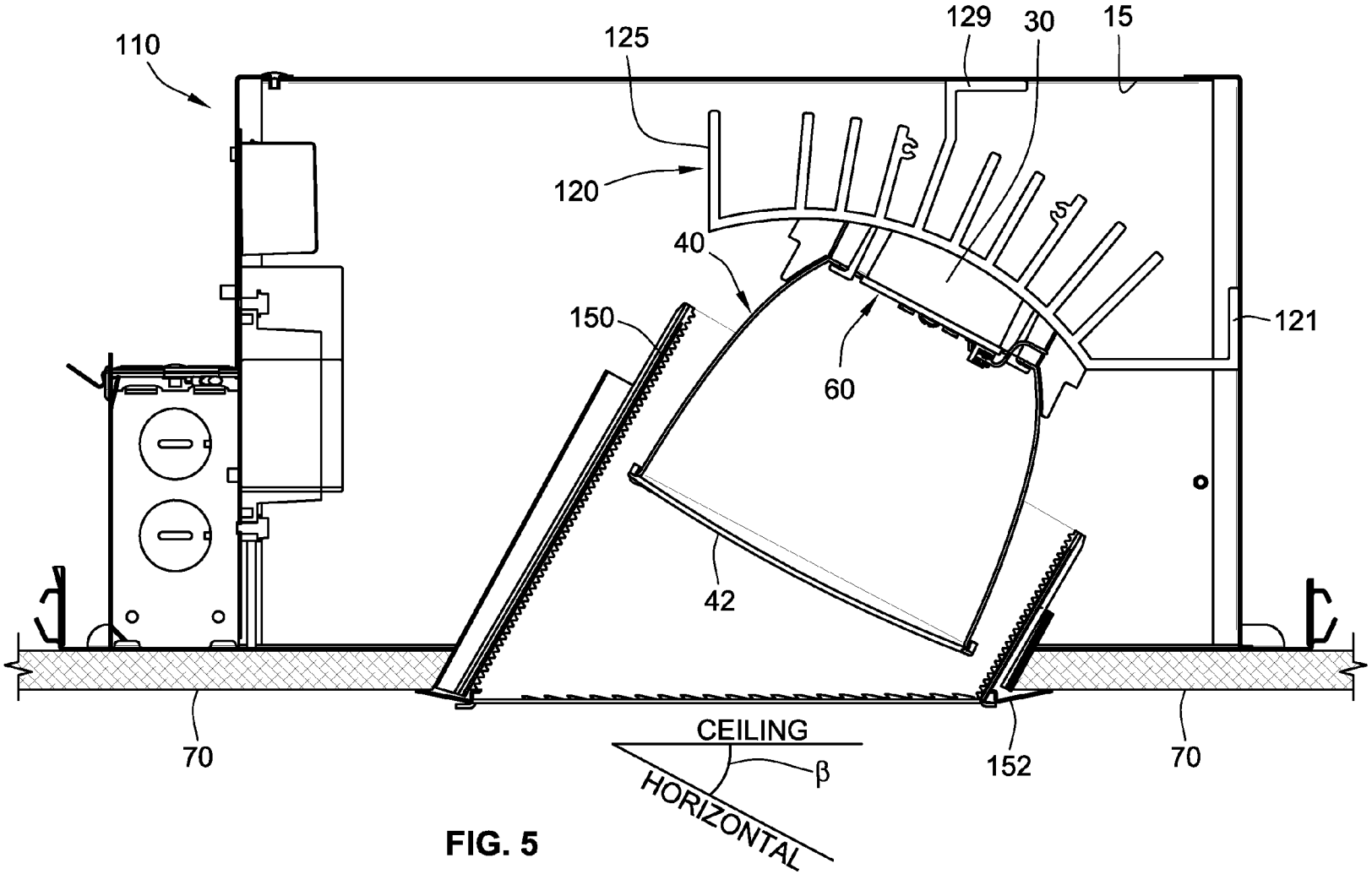
FIG. 5 is an assembled view of a profile cross-section of the recessed lighting fixture shown incorporating the exemplary heat sink shown in FIG. 4B.

FIG. 4B illustrates a perspective view of another exemplary heat sink 120 in another implementation. In this example, instead of having apertures formed in the flange 25, the heat sink 120 includes a bracket 129 having one or more apertures 126 for securing the heat sink 120 to the top surface 15 of the enclosure as shown in FIG. 5 via fasteners such as screws. Optionally, the heat sink 120 in this example includes one or more apertures in a flange 121, which is secured to the end wall 17 of the enclosure 10 by one or more fasteners, such as screws. Optional fastener receiving channels 127 can be formed in one or more of the fins 122 of the heat sink 120 for receiving one or more fasteners, such as screws, for securing the heat sink 120 to one or both of the side walls 13 of the enclosure 110. In this example, there are at least three heat conduction interfaces between the heat sink 120 and the interior of the enclosure 10, i.e., between the flange 121 and the end wall 17, between the bracket 129 and the top surface 15, and between the fastener receiving channels 127 and one or both side walls 13 of the enclosure 110. As with the example shown in FIG. 4A, the heat sink 120 can have more or fewer heat conduction interfaces through which heat energy from the LEDs 62 thermally transferred to the heat sink 120 via the sliding plate 30 can be conductively transferred to the enclosure 110.

FIG. 5 is an assembled view of a profile cross-section of the recessed lighting fixture shown incorporating the exemplary heat sink 120 shown in FIG. 4B. The view shown in FIG. 5 is similar in some respects to the view shown in FIG. 1B except that the fixed heat sink 20 is replaced by the heat sink 120, the baffle 50 is replaced by the high angle baffle 150, and the enclosure 10 is replaced by the enclosure 110. In the assembled configuration illustrated in FIG. 5, the light fixture (e.g., the fixture including the LED panel 60, the reflector 40, and the lens 42) is adapted to be oriented at an angle with respect to the plane of the ceiling, such as the angle β, shown in FIG. 5. The bracket 129 is mounted to the top internal surface 15 of the enclosure 110 and the flange 121 is mounted to a side wall of the enclosure 110. Due to the bracket 129, an end 125 of the heat sink 120 is not separately mounted to a wall of the enclosure 110. The combination of the thermally conductive mounting points and the radiative dissipation of heat energy via, for example, the fins 122 of the heat sink 120 provide for thermal management of the LED panel 60 mounted on the sliding plate 30. The operation of the sliding plate 30 to adjust to different positions on the heat sink 120 is similar to the description included above for the sliding plate 30 and the heat sink 20, although the heat sink 120 may allow the range of angles that the reflector 40 defines with respect to a plane of the ceiling to be different from, and greater than, the range of angles available with the heat sink 20.

The high angle baffle 150 and the trim ring 152 are configured to provide a finished appearance from below the recessed light fixture. The high angle baffle 150 extends from a hole in the ceiling toward the lens 42 of the light fixture and can generally define a path for the light from the LED array 60 to propagate along.

Considering both the implementation shown in FIG. 1B and the implementation shown in FIG. 5, the implementation shown in FIG. 1B can be a light fixture adapted for providing a vertically oriented (relative to a horizontal floor) recessed downlight for a ceiling having a slope in the range of 2/12 to 6/12 pitch (i.e., a in the range of 9° to 27°). The range thus defined corresponds to a preferable range of adjustment of the light fixture with respect to the plane of the ceiling, which is achieved by sliding the sliding plate 30 with respect to the heat sink 20. The implementation shown in FIG. 5 can be a light fixture adapted for providing a vertically oriented (relative to a horizontal floor) recessed downlight for a ceiling having a slope in the range of 7/12 to 12/12 pitch (i.e., β in the range of 30° to 45°). The range thus defined corresponds to a preferable range of adjustment of the light fixture with respect to the plane of the ceiling, which is achieved by sliding the sliding plate 30 with respect to the heat sink 120.

In an example implementation of the present disclosure, the enclosure 10 can have a width dimension of 13⅛", a height dimension of 7⅝", and a depth dimension of 9⅛", while the enclosure 110 can have a width dimension of 15½", the other dimensions being equivalent to the enclosure 10. Furthermore the enclosure 10 can be adapted to be positioned over a ceiling rough opening defined by an ellipse having axes of 7 1/32" and 6 11/16" while the enclosure 110 can be adapted to be positioned over a ceiling rough opening defined by an ellipse having axes of 8 7/32" and 6 9/16". The increased width dimension of the enclosure 110 relative to the enclosure 10 can allow for the enclosure 110 to house the heat sink 120 and orient the light fixture at the angle β (rather than house the heat sink 20 and orient the light fixture at the angle α).

In addition, the size of the enclosures 10, 110 can be chosen such that when heat is dissipated in a steady state from the LED panel 60 (e.g., after the LED panel 60 has been operating for several hours), the enclosures are sufficiently large to allow an adequate amount of heat to dissipate out ultimately through the external walls of the enclosure 10, 110. Consideration is therefore made to account for the possibility that the external walls of the enclosures 10, 110 are surrounded by thermally insulating materials, such as in an insulated ceiling, and recognition is made that a larger enclosure will have a lower internal temperature in a steady state condition thus described than a smaller enclosure. The steady state operation condition may be particularly important in implementations of the recessed light fixture incorporating seals and/or gaskets to prevent convection of air from the plenum or other unfinished portions of a ceiling to the finished portions below the ceiling.

In implementations, the trim rings 52, 152 are appropriately dimensioned to provide a finished appearance over the elliptical shaped rough openings. In particular, the trim rings 52, 152, and/or the baffles 50, 150 can have elliptical shapes. In implementations, both the baffle 50 and the high angle baffle 150 can remain fixed while the light fixture rotates via the sliding plate 30 sliding along the respective heat sinks 20, 120. The baffle 50 and the high angle baffle 150 can therefore be chosen to approximate a center angle of the range of adjustable angles for the reflector to define with respect to a plane of the ceiling available with the respective heat sinks 20, 120.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. An adjustable assembly for conveying heat away from a fixture, comprising:

a sliding plate having a first side and a second side opposite the first side, the first side adapted for mounting the fixture thereon so as to receive heat energy generated by the fixture and transfer the heat energy to the second side, at least a portion of the second side including a curved surface;

a fixed heat sink having a first side including a mating surface adapted to allow the curved surface of the sliding plate to slide from a first position to a second position while maintaining a substantially flush contact between the curved surface of the sliding plate and the mating surface of the fixed heat sink; and at least one fastener for securing the sliding plate to the fixed heat sink alternately in the first position or the second position, wherein the sliding plate includes an elongated aperture aligned to receive therein the at least one fastener for securing the sliding plate to the fixed heat sink, the elongated aperture having a length dimension oriented such that the sliding plate is adjustable from the first position to the second position while the at least one fastener is anchored in an anchoring point on the fixed heat sink in a loose configuration not tight enough to impede the sliding motion of the sliding plate with respect to the fixed heat sink.

2. The adjustable assembly of claim 1, wherein the fixture includes a light source having a light emitting diode array.

3. The adjustable assembly according to claim 2, wherein the sliding plate includes at least one clip for receiving a tab associated with a reflector for removably coupling the reflector to the sliding plate, the reflector adapted to direct light emitted from the light source.

4. The adjustable assembly according to claim 1, further comprising:

an enclosure for housing the sliding plate, the fixed heat sink, and the fixture in a recessed cavity of a sloped ceiling, the fixed heat sink being securely attachable to an inner wall of the enclosure such that at least one of the first position or the second position of the sliding plate is a position orienting the fixture vertically downward with respect to a horizontal floor.

5. The adjustable assembly according to claim 4, wherein the curved surface of the second side of the sliding plate is a portion of an external cylindrical surface being described according to conventional cylindrical coordinates of radius, angle, and height, the angular extent of the curved surface being less than pi radians, the radius being independent of angle, the mating surface being a complementary portion of an internal cylindrical surface being described according to the same conventional cylindrical coordinates; and wherein the enclosure is dimensioned such that the enclosure contains points distant from the mating surface by an amount of its characteristic radius in a direction outwardly normal from the mating surface of the fixed heat sink.

6. The adjustable assembly according to claim 1, wherein the curved surface of the second side of the sliding plate is a portion of an external cylindrical surface being described according to conventional cylindrical coordinates of radius, angle, and height, the angular extent of the curved surface being less than pi radians, the radius being independent of angle, the mating surface being a complementary portion of an internal cylindrical surface being described according to the same conventional cylindrical coordinates.

7. The adjustable assembly according to claim 1, wherein the fixed heat sink includes a plurality of fins extending from a side of the fixed heat sink opposite the mating surface of the first side, the plurality of fins adapted to radiate the heat energy conveyed from the fixture.

8. The adjustable assembly according to claim 1, wherein the fixed heat sink is an extruded die cast component composed of aluminum.

9. A system for dissipating thermal energy, the system comprising:

a sliding plate having a first side and a second side opposite the first side, the first side adapted to mount a heat generating device thereon, the sliding plate adapted to conductively transfer thermal energy from the first side of the sliding plate to the second side of the sliding plate, at least a portion of the second side including a curved surface;

a fixed heat sink having a first side including a mating surface adapted to allow the curved surface of the second side of the sliding plate to slide from a first position to a second position while maintaining a substantially flush contact between the curved surface of the sliding plate and the mating surface of the fixed heat sink, the fixed heat sink adapted to receive conductively transferred thermal energy from the sliding plate via the substantially flush contact between the curved surface of the sliding plate and the mating surface of the fixed heat sink;

at least one fastener for securing the sliding plate to the fixed heat sink alternately in the first position or the second position; and an enclosure for housing the sliding plate, the fixed heat sink, and the heat generating device within a recessed cavity of a finished construction, the fixed heat sink being securely attachable to an inner wall of the enclosure such that at least one of the first position or the second position of the sliding plate is a position orienting the heat generating device at an angle other than an angle perpendicular to a plane of the finished construction surrounding the recessed cavity, wherein the sliding plate includes an elongated aperture aligned to receive therein the at least one fastener for securing the sliding plate to the fixed heat sink, the elongated aperture having a length dimension oriented such that the sliding plate is adjustable from the first position to the second position while the at least one fastener is anchored in an anchoring point on the fixed heat sink in a loose configuration not tight enough to impede the sliding motion of the sliding plate with respect to the fixed heat sink.

10. The system according to claim 9, wherein the heat generating device includes a light source having a panel of light emitting diodes.

11. The system according to claim 10, wherein the sliding plate includes at least one clip for receiving a tab associated with a reflector for removably coupling the reflector to the sliding plate, the reflector adapted to direct light emitted by the light source.

12. The system according to claim 9, wherein the curved surface of the second side of the sliding plate is a portion of an external cylindrical surface being described according to conventional cylindrical coordinates of radius, angle, and height, the angular extent of the curved surface being less than pi radians, the radius being independent of angle, the mating surface being a complementary portion of an internal cylindrical surface being described according to the same conventional cylindrical coordinates; and wherein the enclosure is dimensioned such that the enclosure contains points distant from the mating surface by an amount of its characteristic radius in a direction outwardly normal from the mating surface of the fixed heat sink.

13. The system according to claim 9, wherein the fixed heat sink includes a plurality of fins extending from a side of the fixed heat sink opposite the mating surface of the first side, the plurality of fins adapted to radiate the thermal energy transferred from the heat generating device via the conductive path including the sliding plate and the fixed heat sink.

14. The system according to claim 9, wherein the fixed heat sink is an extruded die cast component composed of aluminum.

15. A recessed light fixture comprising:

a sliding plate having a first side and a second side opposite the first side, at least a portion of the second side including a curved surface;

a fixed heat sink having a first side including a mating surface adapted to allow the curved surface of the second side to slide from a first position to a second position while maintaining a substantially flush contact between the curved surface and the mating surface, the fixed heat sink including a plurality of fins for radiating heat energy conducted from the first side of the sliding plate, the plurality of fins extending from a side of the fixed heat sink opposite the first side;

at least one fastener for securing the sliding plate to the fixed heat sink alternately in the first position or the second position;

a light source mountable to the first side of the sliding plate;

an enclosure for housing the sliding plate, the fixed heat sink, and the light source, the enclosure including a mounting assembly for securing the enclosure in a recessed cavity of a ceiling, the enclosure having an opening on a side of the enclosure facing a space below the ceiling to be illuminated; and a reflector for directing light emitted by the light source toward the opening of the enclosure, the reflector adapted to removably couple to the sliding plate, wherein the sliding plate includes an elongated aperture aligned to receive therein the at least one fastener for securing the sliding plate to the fixed heat sink, the elongated aperture having a length dimension oriented such that the sliding plate is adjustable from the first position to the second position while the at least one fastener is anchored in an anchoring point on the fixed heat sink in a loose configuration not tight enough to impede the sliding motion of the sliding plate with respect to the fixed heat sink.

16. The recessed lighting fixture according to claim 15, wherein the light source includes an array of light emitting diodes.

17. The recessed lighting fixture according to claim 15, wherein at least one of the first position or the second position aligns the light source and reflector on the sliding plate such that the light emitted by the light source is directed substantially in a direction other than a direction normal with respect to a plane of the ceiling.

18. The recessed lighting fixture according to claim 17, wherein the housing is further adapted to be mounted within a recessed cavity of a sloped ceiling and wherein the light source is adjustable to be directed vertically downward with respect to a horizontal floor.

* * * * *